US005095959A

United States Patent [19]

Komassa et al.

[11] Patent Number: 5,095,959

[45] Date of Patent: Mar. 17, 1992

[54] SLIDE GATE VALVE SYSTEM FOR ASBESTOS COLLECTION APPARATUS

[75] Inventors: Robert L. Komassa; Karl J. Becks, both of Menomonee Falls; Robert M. Reavis, Kansasville, all of Wis.

[73] Assignee: Vacuum Engineering Corporation, Milwaukee, Wis.

[21] Appl. No.: 423,072

[22] Filed: Oct. 18, 1989

Related U.S. Application Data

[63] Continuation of Ser. No. 199,028, May 26, 1988, abandoned.

[51] Int. Cl.[5] ..... B65B 1/06

[52] U.S. Cl. ..... 141/114; 141/314; 141/10

[58] Field of Search ..... 141/10, 114, 313, 314, 141/315, 316, 231; 74/107; 251/193, 250, 326

[56] References Cited

U.S. PATENT DOCUMENTS 1,829,069 10/1931 Standlee ..... 251/250

4,501,622 2/1985 Marchadour ..... 141/91

4,585,041 4/1986 Cavanagh ..... 141/231

*Primary Examiner*—Ernest G. Cusick

*Assistant Examiner*—Casey Jacyna

*Attorney, Agent, or Firm*—Paul R. Puerner

[57] ABSTRACT

A self-cleaning asbestos collection system comprises a covered hopper, and enclosed housing, and a slide gate valve. The slide valve has a valve gate that is operable between a latched position in sealing contact with the hopper mouth and an unlatched position. An over center lock in the latching mechanism assures positive latching. A second mechanism is operable when the valve gate is unlatched to reciprocate the valve gate between positions wherein it covers and uncovers the housing mouth. The housing has a spout under the hopper mouth. As asbestos bag is installed over the spout for receiving material flowing through the hopper mouth and the slide gate valve without contaminating the atmosphere. Water nozzles installed inside the housing make the asbestos collection system self-cleaning.

10 Claims, 2 Drawing Sheets

SLIDE GATE VALVE SYSTEM FOR ASBESTOS COLLECTION APPARATUS

This is a continuation of Ser. No. 07/199,028, filed 05/26/88, now abandoned.

BACKGROUND OF THE INVENTION

1. Field of the Invention

This invention pertains to material handling, and more particularly to apparatus for storing and discharging hazardous substances.

2. Description of the Prior Art

The dangers associated with asbestos are now known. Unfortunately, those dangers were not recognized in former times, and a great many buildings have been constructed with duct and pipe wrappings and other components that contain asbestos. The possibility of future health problems requires that the asbestos containing components be removed from existing buildings.

Asbestos is just as dangerous to the workmen removing the asbestos components from a building as it is to the people occupying the building. The workmen must wear special clothing. The asbestos components must be removed from the ducts, pipes, or other structures with great care so that asbestos containing dust and particles do not contaminate the building. The asbestos containing materials must be collected and then disposed of without harm to the asbestos removing workers or to other persons working or visiting in the building.

SUMMARY OF THE INVENTION

In accordance with the present invention, an asbestos collection system is provided that more safely and efficiently handles asbestos containing material than previously available equipment. This is accomplished by apparatus that includes a self cleaning valve for controlling the flow of material from a collection hopper to disposable containers.

The asbestos collection system comprises a large enclosed hopper for temporarily storing asbestos containing material. The hopper may form part of a vacuum system for collecting the asbestos material from the building source. The hopper may be shaped as an inverted cone with the cone apex serving as a mouth through which the material is controllably discharged.

To control the flow of asbestos material from the hopper, the present invention includes a slide gate valve. The slide gate valve comprises a valve gate that is slidable across the hopper mouth. When the gate is in a first position, it closes the hopper mouth and blocks vertical flowage of the asbestos material from the hopper. In a second open position, the gate uncovers the hopper mouth such that the material in the hopper may fall by gravity into waiting containers.

The gate is horizontally slidable between the closed and opened positions within a generally enclosed housing mounted to the lower end of the hopper. The housing is sized to enclose the valve gate in both the opened and closed positions, such that the valve gate is in almost complete separation from the surrounding atmosphere. To control the valve gate, the sliding gate valve includes a wheel and lever that are conveniently mounted to the outside of the housing. The wheel actuates a drive mechanism that translates the valve gate horizontally between the open and closed positions. The lever operates a mechanism that selectively raises or lowers the gate onto or off of the hopper mouth, respectively. Sealing between the hopper mouth may be by a wiper-seal combination installed in the hopper mouth. With the gate in the latched position, vacuum can be created in the hopper for collecting asbestos material therein. The sliding gate valve housing is fabricated with a vertically oriented spout, which is preferably directly below the hopper mouth. The housing spout has a diameter less than the diameter of asbestos carrying bags. Surrounding the spout on the outside thereof is a bag clamp that releasably secures an asbestos bag to the spout. To assure a positive seal between the spout and the asbestos bag, the bag clamp has an inwardly facing circumferential flange that overlaps the spout free end. With an asbestos bag installed on the spout, the interior of the hopper, housing and slide gate valve are isolated from the surrounding atmosphere.

Further in accordance with the present invention, the slide gate valve housing contains a series of water jets. The jets direct water onto the interior walls of the housing to wash asbestos dust and particles therefrom and into the asbestos bag. The housing interior walls are lined with a non-stick surface, thereby facilitating the washing process. In that manner, very few if any asbestos particles remain in the housing to migrate to the environment when the asbestos bag is being replaced.

The asbestos collection system of the present invention may be mounted to a truck or other vehicle, thereby rendering the system portable. Further, the hopper may be vertically movable on the vehicle between a raised operative position and a lowered inoperative position. In the inoperative position, the spout is only a short distance above the ground. In the raised operative position, there is ample clearance under the spout for supporting an asbestos bag clamped to the spout.

Other objects and features of the invention will become apparent to those skilled in the art upon reading the disclosure.

BRIEF DESCRIPTION OF THE DRAWINGS

FIG. 5 is an elevational view of the linkage for raising and lowering a sliding gate valve which is in the fragmentarlly shown housing, said linkage being isolated from FIG. 1 and enlarged relative thereto, the linkage presently being operated to a condition which results in the gate valve being in its unlateched or lowermost position as aslo shown in FIG. 4;

FIG. 6 is similar to FIG. 5 except that the linkage has been operated to a condition which results in the gate valve member being in its uppermost or latched position as is the case as in FIGS. 2 and 3; and FIG. 7 is a plan view of the linkage shown in FIG. 6.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
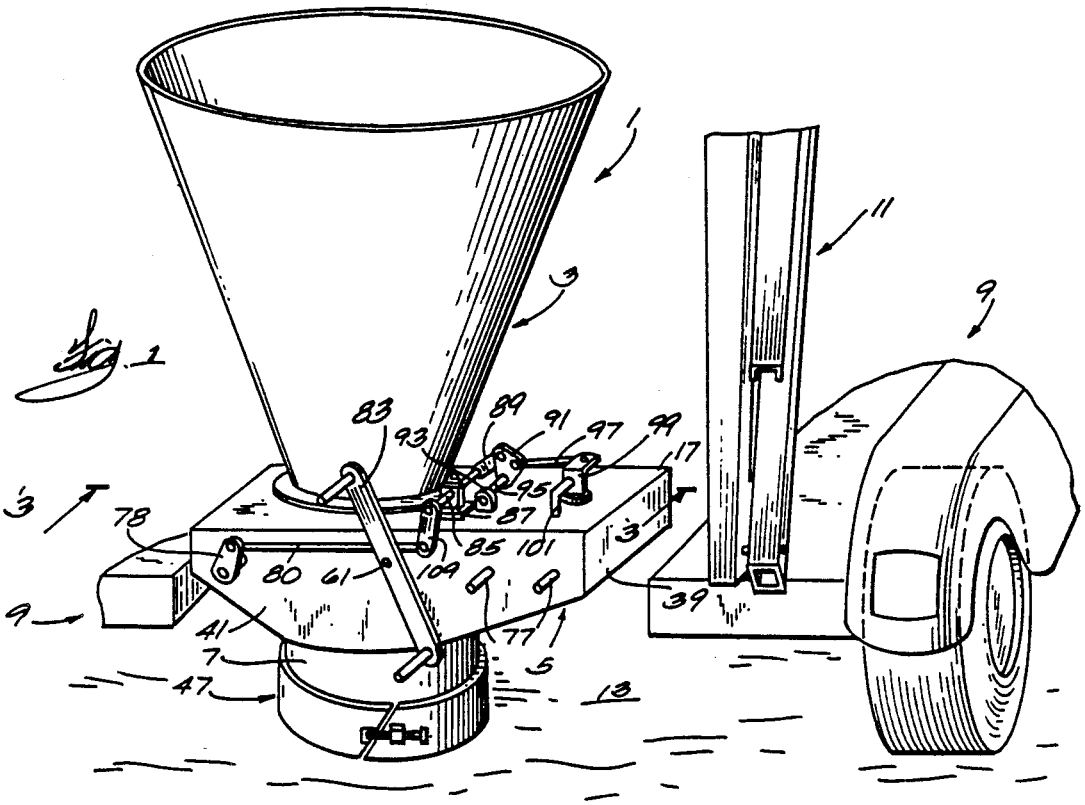
FIG. 1 is a perspective view of the present invention in a first inoperative position.
Figure 2:
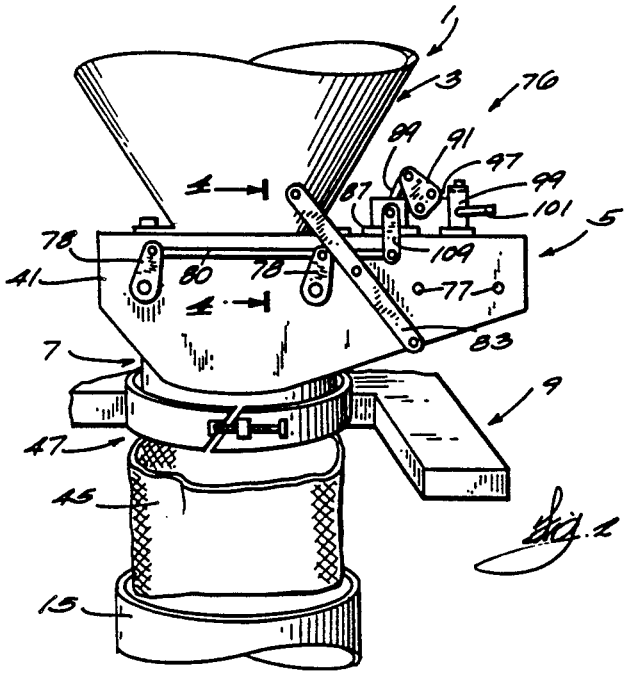
FIG. 2 is a front view of the present invention generally similar to FIG. 1, but showing the asbestos collection system in a second operative position.

Referring to FIGS. 1 and 2, an asbestos collection system 1 is illustrated that includes the present invention. The collection system 1 is particularly useful for collecting and discharging asbestos contaminated materials, but it will be understood that the invention is not limited to applications involving dangerous substances.

The asbestos collection system 1 comprises a hopper 3, a housing 5, and a spout 7. The collection system may be mounted on a vehicle, represented schematically by reference numeral 9, thereby rendering the system readily transportable between job sites. The system may be mounted on the vehicle 9 by means of structural supports 11 joined to the upper end of the hopper 3 by any suitable means, not shown. The supports 11 may be rotated and extended by known hydraulic means mounted to the vehicle, not illustrated in FIGS. 1 or 2, to vertically translate the hopper, housing 5, and spout 7. In a lowered inoperative position such as is shown in FIG. 1, the spout is fairly close to the ground 13, with a clearance on the order of approximately 1.5 feet. In a raised operative position, FIG. 2, the system is far enough above the ground 13 to place a large container, such as a fifty-five gallon drum 15, under the spout.

Figure 3:
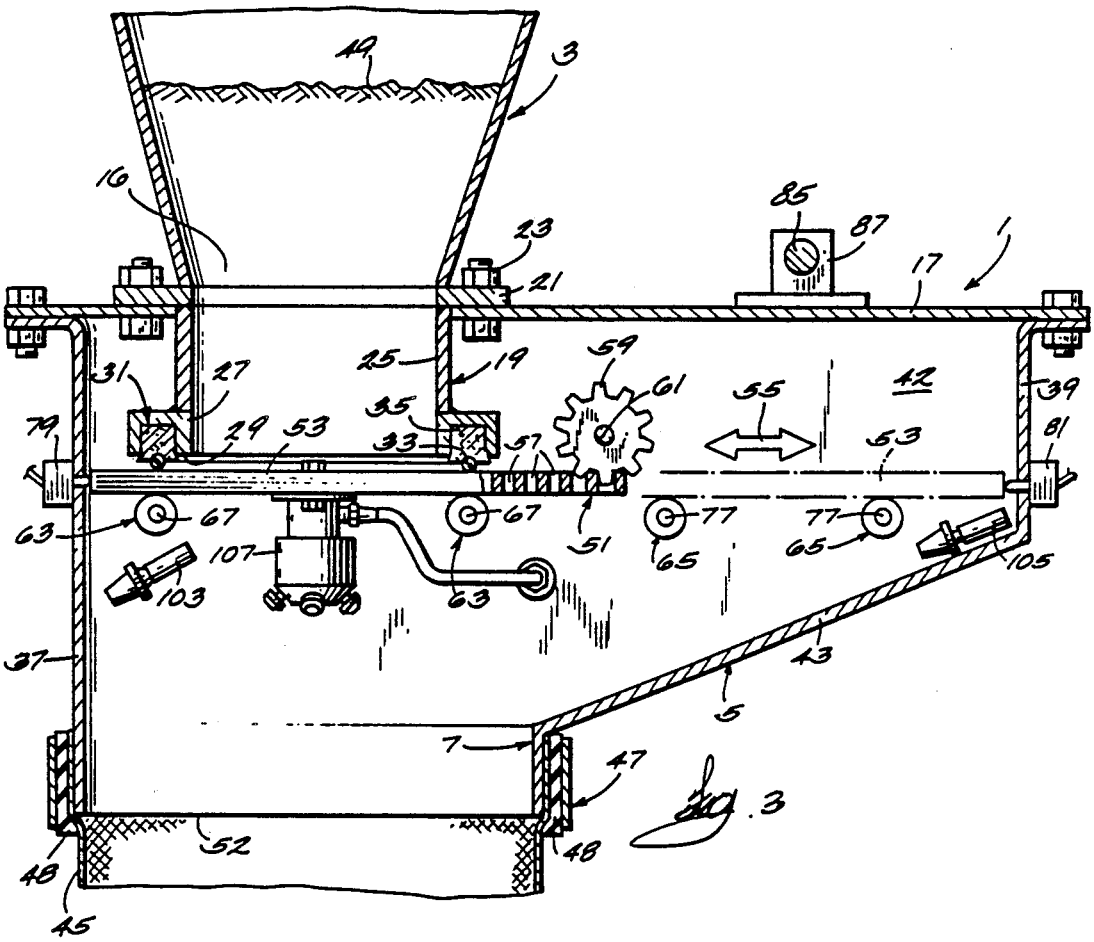
FIG. 3 is an enlarged cross sectional view taken along lines 3—3 of FIG. 1.

Looking also at FIG. 3, the hopper 3 is fabricated as an enclosed air tight thin walled vessel, which may have a generally frusto-conical shape. The hopper lesser diameter forms the hopper discharge or mouth 16. The hopper is mounted to a top plate 17 of the housing 5 by suitable fasteners 23. The flange 21 is joined to the hopper lower end in an air tight manner. The tube 19 has a center section 25 that passes through an opening in the housing top plate 17. The lower end of the tube has an outwardly annular flange 27. In the bottom face 29 of the tube lower flange 27 is installed an annular combination seal 31. The combination seal 31 is designed with an O-ring 33 and a wiper 35.

In addition to the top plate 17, the housing 5 comprises opposed end walls 37 and 39, a front wall 41, a back wall 42, and a sloped bottom wall 43. The spout 7 is generally cylindrical in shape, and it may be integrally joined to the lower ends of the housing walls 37, 41, 42, and 43. Except for the spout and the housing mouth 16, the housing is fully enclosed. The spout has a diameter less than the diameter of a conventional asbestos bag 45. Surrounding the spout and retained thereon is a bag clamp 47. The clamp 47 is shown in the clamped position in FIG. 3. For clarity, exaggerated clearances are shown between the clamp components, the bag 45, and the spout 7. The bag clamp includes a compressible ring 48. When the clamp is actuated, the compressible ring 48 extends below and overlaps the spout end face 52, thereby assuring a positive seal between the spout and the bag such that when the inside of bag 45 is washed down no material will remain on the upper portion of the bag. Thus when the bag is removed it will be free of contanimants in the closure portion thereof.

To control the flow of material 49 collected in the hopper 3, a slide gate valve 51 is installed in the housing 5. The slide gate valve 51 comprises a flat valve gate 53 that is horizontally reciprocable within the housing in the directions of arrow 55. To reciprocate the gate 53, it is formed with a series of openings 57 extending vertically therein. Also see FIG. 4. The openings 57 are designed to mesh with the teeth of a cog 59 that is mounted for rotation about a horizontal axis on shaft 6I. The shaft 6I is mounted for rotation in brackets 62 in the housing opposed front and back walls 41 and 42, respectively. Rotating the shaft 61 clockwise with respect to FIG. 3 causes the gate to translate to the left, that is, to a position under the hopper mouth 16 and tube 19. Rotating the shaft 61 counterclockwise with respect to FIG. 3 causes the gate to translate to the right to the position indicated by the phantom lines 53', thereby uncovering the hopper mouth.

To rotate the shaft 61 and cog 59 for translating the valve gate 53, the shaft 61 extends through the housing front wall 4I. The shaft 61 terminates on the outside of the housing 5 in a handle 83. Thus, by turning the handle 83 on the outside of the housing, the valve gate is translated inside the housing.

To support the valve gate 53 within the housing 5, the slide gate valve 51 further comprises a series of rollers. The rollers are mounted in the housing front and back walls 41 and 42, respectively. At least three sets of rollers 63 are used in the vicinity of the hopper tube 19, and at least two additional sets 65 are employed remote from the tube 19 and close to the housing end wall 39. The rollers 63 are mounted on eccentric shafts 67 that pivotally extend through the housing front and back walls. With the shafts 67 in the position shown in FIG. 4, the roller centerlines 69 are at a location below the shaft centerline 71. In that condition, the gate is in an unlatched position, resting on the rollers such that there is a clearance "C" between the seal 31 and the upper surface 73 of the gate. By rotating the shafts 67 by a mechanism to be described presently, the rollers 63 are moved upwardly with respect to FIGS. 3 and 4. In turn, the rollers raise the gate a short distance in the direction of arrow 75. Raising the gate places it in a latched position, wherein the clearance "C" is taken up, and the gate upper surface 73 is forced against the seal 31, as shown in FIG. 3. Only when the gate is in the lower or unlatched position of FIG. 4, away from the seal 31, is the shaft 61 rotated to turn the cog 59 and translate the gate in the directions of arrow 55.

The rollers 65 are mounted on stub shafts 77 that are fixed to the housing front and back walls 41 and 42, respectively. The centerlines of the shafts 77 and rollers 65 coincide, and those centerlines are in line With the centerline 69 of the rollers 63 when the rollers 63 are in the lowered position of FIG. 4. Thus, with the rollers 63 in the lowered position, the unlatched gate 53 slides easily along the rollers 63 and 65 under the influence of the cog 59.

Figure 4:
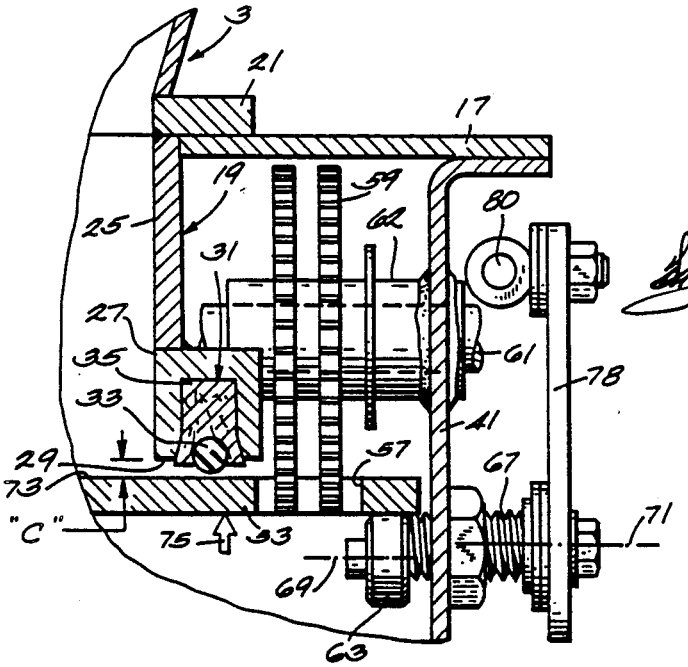
FIG. 4 is an enlarged cross sectional view taken along lines 4—4 of FIG. 2.

To rotate the eccentric shafts 67 for latching and unlatching the valve gate 53, a control linkage 76 is employed. Linkage 76 is shown in FIGS. 1 and 2 but it will be described in reference to the FIGS. 5, 6 and 7 enlarged views. The control linkage 76 includes short levers 78 that are fixed at one end thereof to the ends of the shafts 67, which protrude outside the housing walls 41 and 42. The second ends of the respective levers 78 are pivotally connected to a common tie rod 80. One end of the tie rod 80 is connected to another lever 109 that is pivotable by means of shaft 85 in a bearing block 87. To the shaft 85 is fixedly mounted to one end of a short arm 89. The second end of the arm 89 is pivotally connected to one corner of a triangular link 91. A second corner of the triangular link 91 is pivotally fastened to a block 93 fixed on the housing top plate 17 by means of a short pin 95. The third corner of the triangular link 91 is pivotally connected to one end of a rod 97. The second end of the rod 97 is pivotally connected to a lever 99. Lever 99 is fastened to a sleeve 96 which is journaled on a stud shaft 98 that is mounted to the housing cover plate 17. Thus, the sleeve is rotatable about a vertical axis. By pushing the handle 10l which is fastened to sleeve 96 forwardly toward, the hopper 3, the levers 78 are rotated together to lower the rollers 63 and unlatch the valve gate from the hopper tube seal 31. Such a condition is shown in FIGS. 1 and 4. Pushing the handle 101 backwardly away from the hopper operates the levers 78 to latch the valve gate in a sealing position against the hopper seal 31. The latched condition is shown in FIGS. 2 and 3. The arm 89, triangular link 91, and link 95 form an over center lock toggle or such that the valve gate is positively latched in place when the handle 101 is in the back position as it is in FIG. 6.

To control the operation of the asbestos collection system 1 of the present invention, various devices may be used that actuate in response to the performance of other components. For example, a first limit switch 79 may be mounted to the housing wall 37 for sensing when the valve gate 53 is in the closed position under the hopper mouth 16. Actuation of the limit switch 79 by the closed gate can start operation of the vacuum system for collecting material 49 into the hopper 3. Another limit switch 81 can be used to sense the opened gate and start operation of a mechanical loading device, not shown, that forces the material 49 through the hopper mouth and tube 16 and into an asbestos bag 45.

Further in accordance with the present invention, the housing 5 of the asbestos collection system 1 is self-cleanable of asbestos material For that purpose, the inside surfaces of the walls 37, 39, 41, 42, and 43 are coated with a non-stick material. The internal moving parts are stainless steel. To remove as much asbestos material as possible from the housing, a water flushing system is employed. Front nozzles 103 are directed onto the wall 37, and nozzles 105 are located near the end wall 39. Multiple nozzles 107 are mounted to the underside of the valve gate 53. The various nozzles are arranged to wash the asbestos dust and particles from virtually the entire interior surface of the housing.

In operation, the vehicle hydraulic unit is energized to drive the structural supports 11 and place the hopper 3, housing 5, and spout 7 in the raised operative position of FIG. 2. The bag clamp 47 is opened. The mouth of an asbestos bag 45 is placed over the spout 7 and the bag clamp is closed. The bag may be supported in a drum 15.

For safety purposes, the asbestos collection system controls are designed such that the slide gate valve 51 must be cycled before the hopper vacuum system will operate. For that purpose, the handle 101 of the control linkage 76 is pushed forwardly toward the hopper 3 to unlock the over center lock that includes the links 91 and 89. The valve gate 53 is thus unlatched. Turning the handle 83 counterclockwise with respect to FIGS. 1 and 2 translates the valve gate to uncover the hopper mouth and actuate the rear control limit switch 81. The gate handle 83 is then turned clockwise to translate the gate under the hopper mouth. Doing so actuates the limit switch 79 to start the hopper vacuum system or some other control functions. Pushing the control linkage handle 101 backwardly away from the hopper causes the gate to latch against the tube seal 31, so that a vacuum is created in the hopper to draw asbestos material 49 into it.

To empty the hopper 3, the handle 101 is pushed forwardly to unlock the over center lock, and the gate handle 83 is turned counterclockwise to uncover the hopper mouth 16. When the bag 45 is full or hopper 3 is empty gate handle 83 is then turned clockwise closing gate 53 under hopper mouth 16 and then latch handle 101 is turned lift gate member 53 so it selas to the bottom of the hopper. Then open control valves, not shown, which when actuated will furnish water to the spray nozzles 103 105, and 107. The nozzles are directed to wash the interior of the housing 5. Water is sprayed until only clear water is washed down to the asbestos bag 45. The bag is necked down under the spout 7 and tightly tied. The bag clamp 47 is unclamped, the filled bag is removed, and a new bag is installed. For storage, a bag is inserted over the spout, and the slide gate valve is placed in the latched position with the control linkage handle 101 in the over center locked position. In that manner, the slide gate valve and the rest of the housing interior are isolated both from the hopper interior and from the atmosphere.

Thus, it is apparent that there has been provided, in accordance with the invention, a slide gate valve system for asbestos collection apparatus that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, as fall within the spirit and broad scope of the appended claims.

I claim:

1. A hazardous material collection system such as for collecting asbestos, comprising:

an enclosed hopper for holding a quantity of asbestos containing materialk and having a discharge mouth;

a generally enclosed housing attached to the hopper adjacent the mouth, said housing having a top side, a bottom side and enclosing lateral sides connecting the top and bottom sides, said mouth extending into said housing through the top side of said housing;

a spout attached to the bottom side of said housing remotely from said mouth for directing material discharged from the hopper mouth to the outside of the housing;

a substantially planar gate valve member mounted for moving in the housing transversely to the mouth for selectively covering and uncovering the hopper mouth to prevent and permit, respectively, discharge of material therefrom;

a seal surrounding said mouth for being engaged by said gate valve member when said mouth is covered;

means inside of said housingn and operable from outside of said housing to move said gate valve member, and clamp means for releasably clamping a bag to the spout, so that the gate valve means and interior of the housing are isolated from the surrounding atmosphere when a bag is installed on the spout and asbestos material discharged from the hopper is collectable in the bag without contaminating the atmosphere.

2. The hazardous material collection system according to claim 1 wherein:

said planar slide valve member has a row of holes constituting cog means, and a cog wheel engaged in said holes and being rotatable for reciprocating the gate valve member between positions that cover and uncover the hopper mouth;

first roller means mounted to the housing for supporting the valve member when it is in the position covering the hopper mouth;

second roller means mounted to the housing for supporting the valve member when it is in the position uncovering the housing mouth;

control linkage means for actuating the first roller means for guiding said valve member and movable to selectively latch the valve member into sealing contact with the hopper mouth and unlatch the valve member away from sealing contact with the hopper mouth, and handle means located outside the housing for rotating the cog wheel.

3. The hazardous material collection system of claim 1 further comprising spray means installed in the housing for washing the housing interior of asbestos material, the water and material being washed into the asbestos bag, so that the asbestos collection system is self-cleaning.

4. A hazardous material collection system such as for collecting asbestos containing material comprising:

an enclosed hopper for holding a quantity of asbestos containing material and having a discharge mouth;

a generally enclosed housing attached to the hopper adjacent the mouth, said mouth being directed into said housing;

a spout attached to the housing remotely from said mouth in alignment therewith for directing material discharged from the hopper mouth to the outside of the housing;

a substantially planar gate valve member mounted for moving in the housing transversely to the mouth for selectively covering and uncovering the hopper mouth to prevent and permit, respectively, the discharge of material therefrom;

a seal surrounding said mouth for being engaged by said gate valve member when said mouth is covered;

means inside of said housing and operable from outside of said housing to move said gate valve member, and first roller means mounted to the housing for supporting the valve member when it is in the position covering the hopper mouth;

second roller means mounted to the housing for supporting the valve gate when it is in the position uncovering the housing mouth;

a plurality of eccentric shafts rotatably mounted to the housing;

a one of said first rollers mounted to each eccentric shaft, control linkage means for rotating said eccentric shafts alternately to latch the gate member into sealing contact with the hopper mouth and unlatch the hopper member from sealing contact with the hopper mouth, and clamp means for releasably clamping a bag to the spout, having a bag clamped on the spout causing isolation of the interior of the housing from the atmosphere.

5. The hazardous material collection system according to claim 4 wherein the control linkage means comprises:

a plurality of levers, each lever being fixed at one end therof to a respective eccentric shaft;

the rod means and means for pivotally connecting the second ends of the respective levers to said rod means;

a handle mounted to the housing for selectively pivoting between a position wherein said valve member is latched and a position wherein said valve member is unlatched; and link means connecting the handle to the tie rod means.

6. The hazardous collection system according to claim 5 wherein the link means connecting the handle to the tie rod means comprises an over center lock for positively locking the gate valve member in latched sealing contact with the hopper mouth when the handle is in the latched position.

7. Apparatus for temporarily storing and discharging particulate matter comprising:

a generally enclosed hopper having a discharge mouth;

a housing attached to the hopper adjacent the mouth thereof;

a generally planar gate valve member mounted in the housing;

means for reciprocating the gate valve member within the housing between a first position wherein the member covers the hopper mouth and a second position remote from the hopper mouth;

link means for moving the gate valve member within the housing between a latched position wherein the gate valve member is in sealing contact with the hopper mouth and an unlatched position wherein the gate valve member is in unsealing relationship with the housing mouth;

spout means joined to the housing under the hopper mouth for directing discharge of the material from the hopper;

clamp means surrounding the spout means for releasably clamping a container to the spout means to receive material discharged from the hopper mouth so that material discharged from the hopper enters the bag without contaminating the surrounding atmosphere, first roller means rotatably mounted in the housing for supporting the valve member when the valve gate is in the first position covering the hopper mouth;

second roller means fixedly mounted to the housing for supporting the valve member when the valve member is in the second position remote from the hopper mouth; and control linkage means mounted to the housing exterior for selectively rotating the first roller means to move the valve member between the latched and unlatched positions, said first roller means comprising a plurality of eccentric shafts rotatably mounted to the housing and extending through the walls thereof;

a roller mounted on each eccentric shaft inside the housing, the rollers being positioned to support the valve member; and the control linkage means comprises lever means for selectively rotating the eccentric shafts to cause the respective rollers mounted thereon to raise the gate valve member into latched position against the hopper mouth and to lower the gate valve member to the unlatched position away from the hopper mouth.

8. The apparatus according to claim 1 wherein:

the gate valve member has a plurality of openings therein arranged in a row; and cog means for reciprocating the gate valve member comprising:

at least one cog rotatably mounted in the housing and meshing with the gate valve member openings; and handle means located outside the housing for rotating the cog, so that rotating the handle means outside the housing reciprocates the gate member inside the housing.

9. The apparatus according to claim 7 wherein the control linkage means further comprises an over center lock for positively locking the gate valve member in the latched position.

10. The apparatus of claim 7 further comprising means located inside the housing for washing particle matter from the housing interior and into a bag clamaped to the spout to thereby render the apparatus self-clamping.

* * * * *